US011174682B2

(12) United States Patent
Doud et al.

(10) Patent No.: US 11,174,682 B2
(45) Date of Patent: Nov. 16, 2021

(54) PAD RETENTION ASSEMBLY FOR ROTARY STEERABLE SYSTEM

(71) Applicant: Halliburton Energy Services, Inc., Houston, TX (US)

(72) Inventors: Brian Lee Doud, Spring, TX (US); Neelesh V. Deolalikar, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/757,051

(22) PCT Filed: Mar. 2, 2018

(86) PCT No.: PCT/US2018/020785
§ 371 (c)(1),
(2) Date: Apr. 17, 2020

(87) PCT Pub. No.: WO2019/133035
PCT Pub. Date: Jul. 4, 2019

(65) Prior Publication Data

US 2020/0332597 A1 Oct. 22, 2020

Related U.S. Application Data

(60) Provisional application No. 62/612,207, filed on Dec. 29, 2017.

(51) Int. Cl.
*E21B 7/06* (2006.01)

(52) U.S. Cl.
CPC ..... *E21B 7/067* (2013.01)

(58) Field of Classification Search
CPC ..... E21B 7/04; E21B 7/06; E21B 7/067
See application file for complete search history.

(56) References Cited

U.S. PATENT DOCUMENTS 5,520,255 A * 5/1996 Barr ..... E21B 4/003 175/24
2005/0098353 A1 5/2005 Maxwell et al.
2010/0139980 A1 6/2010 Neves et al.
2013/0118812 A1 5/2013 Clausen et al.
(Continued)

FOREIGN PATENT DOCUMENTS

EP 0677640 10/1995
WO 2016130865 8/2016

OTHER PUBLICATIONS

ISRWO International Search Report and Written Opinion for PCT/US2018/020785 dated Sep. 28, 2018.

*Primary Examiner* — Dany E Akakpo
(74) *Attorney, Agent, or Firm* — Benjamin Ford; C. Tumey Law Group PLLC

(57) ABSTRACT

A rotary steerable tool for steering a drill string can include a tool collar, a plurality of pad pushers, and a plurality of fasteners. The pad pushers can each be positionable within a respective cavity of the tool collar. Each pad pusher can be coupled to a pad retention housing that has an engagement hole and a through hole spaced apart from the engagement hole. The pad pushers can be interconnected by a plurality of fasteners. Each fastener can extend between adjacent pad retention housings to interconnect the plurality of pad pushers around the tool collar.

20 Claims, 6 Drawing Sheets

(56) References Cited

U.S. PATENT DOCUMENTS

| | | | |
|---|---|---|---|
| 2015/0330149 | A1 | 11/2015 | Winslow et al. |
| 2016/0356089 | A1 | 12/2016 | Nanayakkara et al. |
| 2017/0159362 | A1 | 6/2017 | Janes et al. |
| 2018/0128060 | A1* | 5/2018 | Haugvaldstad ..... E21B 7/06 |
| 2018/0252088 | A1 | 9/2018 | Tilley et al. |
| 2019/0249494 | A1 | 8/2019 | Winslow et al. |
| 2019/0352558 | A1 | 11/2019 | Tilley et al. |
| 2020/0011135 | A1 | 1/2020 | Deolalikar et al. |
| 2020/0056451 | A1 | 2/2020 | Chambers et al. |

* cited by examiner

PAD RETENTION ASSEMBLY FOR ROTARY STEERABLE SYSTEM

TECHNICAL FIELD

The present disclosure generally relates to oilfield equipment and, in particular, to downhole tools, drilling and related systems for steering a drill bit. More particularly still, the present disclosure relates to methods and systems for mounting and retaining pad pushers to a tool body.

BACKGROUND

Drilling wellbores in a subterranean formation usually requires controlling a trajectory of the drill bit as the wellbore is extended through the formation. The trajectory control can be used to steer the drill bit to drill vertical, inclined, horizontal, and lateral portions of a wellbore. In general the trajectory control can direct the drill bit into and/or through production zones to facilitate production of formation fluids, direct the drill bit to drill a portion of a wellbore that is parallel to another wellbore for treatment or production assist, direct the drill bit to intersect an existing wellbore, as well as many other wellbore configurations.

Therefore, it will be readily appreciated that improvements in the arts of securing the various components of various downhole tools tightly together, so as to prevent parts of assemblies becoming loose or completely coming apart during drilling operations are continually needed.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
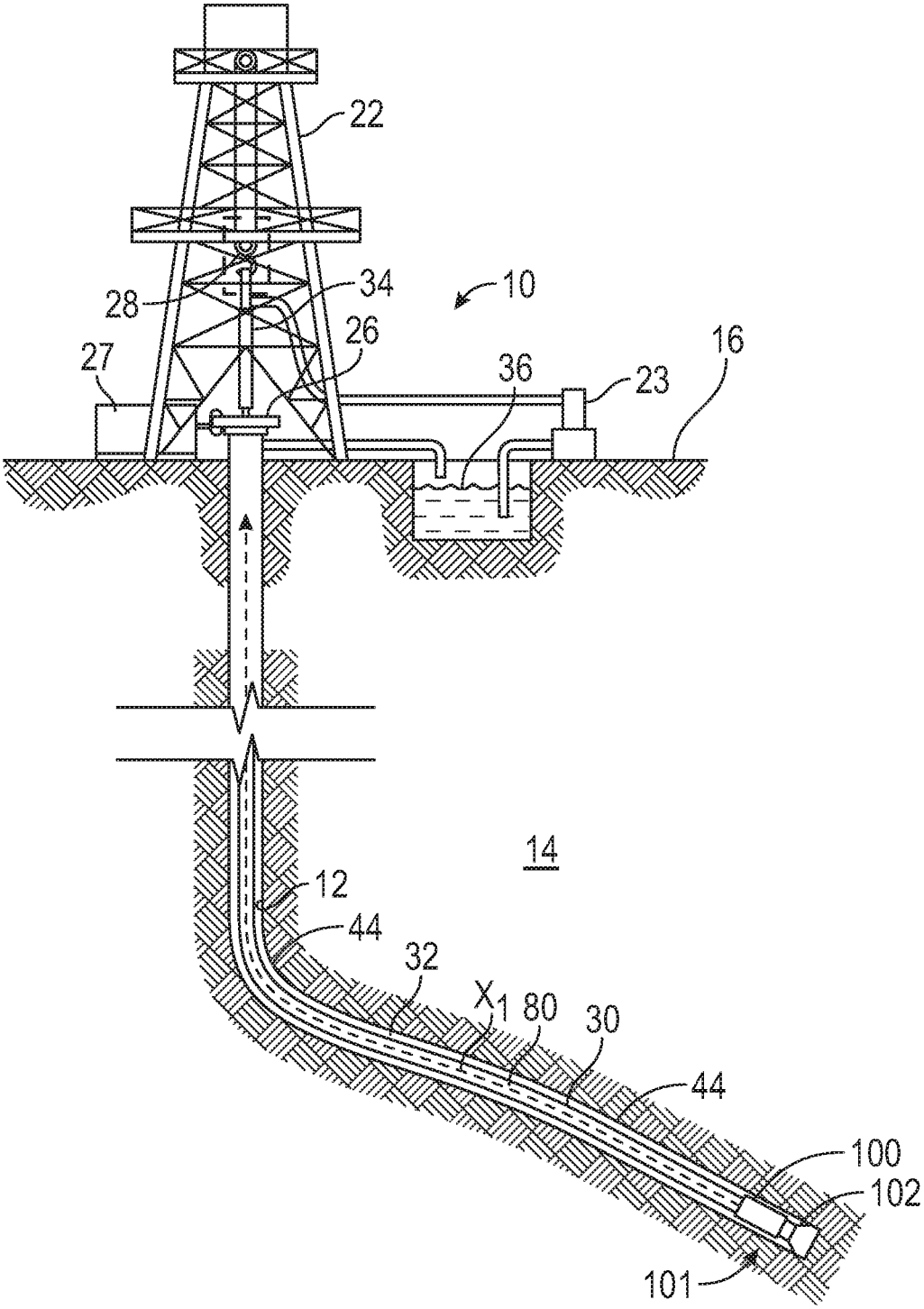
FIG. 1 illustrates a partial cross-sectional view of an onshore well system including a downhole tool illustrated as part of a tubing string, according to some embodiments of the present disclosure.

The disclosure may repeat reference numerals and/or letters in the various examples or Figures. This repetition is for the purpose of simplicity and clarity and does not in itself dictate a relationship between the various embodiments and/or configurations discussed.

The present disclosure relates to methods and systems for robustly mounting steering pads to the collar. Generally the present disclosure describes a rotary steerable tool for steering a drill string in which the steering heads including pad pushers are mounted robustly to the tool body of the drill bit and more specifically to a two color of the drill bit. When drilling downhole, the downhole rotary steerable tool may be subjected to various negative environmental conditions based on formation conditions or texture at the level below ground level where the drilling is taking place. In these instances oftentimes increased wear and tear on the downhole rotary steerable tool may be experienced, as a result of various components of the downhole rotary steerable tool becoming loose or coming apart altogether. This may present issues in terms of the time and cost and efficiency of drilling production wherein such operations where, the downhole rotary steerable tool may need to be brought back to the surface for repair and/or replacement of parts. For example, where the downhole rotary steerable tool has specific moving parts such as steering pads which are mounted to a collar of the downhole tool, and which pivot outwards to engage or contact the formation, these parts may be susceptible to coming loose under extreme downhole conditions, e.g., extreme vibration caused by the drill bit of the downhole tool engaging with various types of formation rocks. In order to prevent the steering pads along with their respective housings from becoming disengaged from the tool collar and the various extreme downhole conditions, it is necessary to mount the housings with the steering pads on the tool collar in such a way that the mounting is as robust as possible. Thus, the mounted parts may be less susceptible to becoming loose or altogether coming apart during extreme downhole vibrations. This may be necessary so as to prevent or minimize loss of various components of the steering head downhole, which will not be able to be retrieved.

The present disclosure relates to methods and systems for robustly and securely mounting steering pads of the steering head to a collar of a downhole tool in a manner that prevents the assembly from coming apart or becoming loose enough to encounter unexpected wear damage or loss of performance under extreme downhole conditions. In some instances extreme downhole conditions include vibrations experienced as a result of the downhole tool contacting or engaging with the formation. In some embodiments of the present disclosure, pad pushers are coupled to pad retention housings, which are then mounted to the tool collar. In particular, in some embodiments the pad retention housings are mounted to the tool collar by being coupled to each other through the tool collar in a triangular configuration. Advantageously, this configuration and method of coupling adjacent pad retention housings to each other and mounting them together to the tool collar allows for longer fasteners, e.g., longer bolts, to be used since. This is possible since the bolts are positioned to extend from their respective pad retention housing through a through hole of the tool collar, and into an engagement hole of an adjacent pad retention housing. In contrast with conventional steering assemblies where the steering pads or the related steering pad housing is bolted separately and directly to the tool collar, the present disclosure allows for longer fasteners to be used. In the conventional steering heads, the length of the bolt is generally confined to an overall cross-sectional combined depth or height of the tool collar and the associated steering head. Use of a long fastener or bolt is possible due to the disclosed configuration whereby the pad retention housings are bolted to each other through the tool collar as opposed to being fastened to just the tool collar. Advantageously, longer fasteners have better vibration absorption capabilities, thereby providing an additional level of security against loosening of the fasteners which couple the housings together about the collar, and against the bolted parts becoming loose or coming apart.

The methods and apparatus described herein, in accordance with some embodiments of the present disclosure, provide all of the aforementioned advantage is, most specifically a robust design of the steering heads which improves downhole reliability, resulting in fewer drilling hours lost for tool repairs and reduced replacement and maintenance costs. The triangular bolting configuration also reduces the number of fasteners (bolts) needed, as six bolts can be used to provide attachment at 12 points (four points of attachment each for three steering pad elements). Threaded bolts to do not need to be machined into the collar, simplifying collar design and reducing potential stress concentrations. Various advantages of such embodiments are discussed further herein.

Further, in some embodiments, the fastener can advantageously be designed with anti-back off protection. For example, one or both ends of each fastener can provide an additional level of security of the bolts within the pad retention assemblies. In particular, each of the bolts can be designed to have an anti-rotation member placed at the head of the bolt to prevent the bolt from rotating with respect to the pad retention housing. Furthermore, the bolts may be designed with a seal assembled to the bottom end thereof which is configured to be placed in the engagement hole of the adjacent pad retention housing. The seal is installed at assembly to both protect the bolt threads from contaminants and corrosion and to prevent back-off. With the seal in place and the fastener engaged with the assembly, a small pocket of air can be trapped beneath or below the seal within the engagement hole. The pocket of air can have an air pressure that is about equal to the air pressure of air at the assembly location (e.g., the entire assembly would be created above ground, thus, the pocket of their below the seal will have air pressure that is about equal to the above-ground air pressure). Thus, when the assembly is downhole, higher hydrostatic pressures at the depths at which the downhole tool is operating can exert pressure against the seal and tend to hold the bolt in place like a piston, tending to reduce mechanical vibration and dislodgement and otherwise enhance the engagement of the fastener in the engagement hole. As such, the steering heads can be more securely mounted on tool collar.

FIG. 1 shows a representative elevation view in partial cross-section of an onshore well system 10 which can include a drilling rig (or derrick) 22 at the surface 16 used to extend a tubing string 30 into and through portions of a subterranean earthen formation 14. The tubing string 30 can carry a drill bit 102 at its end which can be rotated to drill through the formation 14. A bottom hole assembly (BHA) 101 interconnected in the tubing string 30 proximate the drill bit 102 can include components and assemblies (not expressly illustrated in FIG. 1), such as, but not limited to, logging while drilling (LWD) equipment, measure while drilling (MWD) equipment, a bent sub or housing, a mud motor, a near bit reamer, stabilizers, steering assemblies, and other downhole instruments. The BHA 101 can also include a downhole tool 100 that can provide steering to the drill bit 102, mud-pulse telemetry to support MWD/LWD activities, stabilizer actuation through fluid flow control, and a rotary steerable tool used for steering the wellbore 12 drilling of the drill bit 102. Steering of the drill bit 102 can be used to facilitate deviations 44 as shown in FIGS. 1 and 2, and/or steering can be used to maintain a section in a wellbore 12 without deviations, since steering control can also be needed to prevent deviations in the wellbore 12.

At the surface location 16, the drilling rig 22 can be provided to facilitate drilling the wellbore 12. The drilling rig 22 can include a turntable 26 that rotates the tubing string 30 and the drill bit 102 together about the longitudinal axis X1. The turntable 26 can be selectively driven by an engine 27, and selectively locked to prohibit rotation of the tubing string 30. A hoisting device 28 and swivel 34 can be used to manipulate the tubing string 30 into and out of the wellbore 12. To rotate the drill bit 102 with the tubing string 30, the turntable 26 can rotate the tubing string 30, and mud can be circulated downhole by mud pump 23. The mud may be a calcium chloride brine mud, for example, which can be pumped through the tubing string 30 and passed through the downhole tool 100. In some embodiments, the downhole tool 100 can include a steering head, and a rotary valve that selectively applies pressure to at least one output flow path to hydraulically actuate the steering head. Additionally, the mud, if used above the rotary steerable tool and drill bit, can be pumped through a mud motor (not expressly illustrated in FIG. 1) in the BHA 101 to turn the rotary steerable tool and the drill bit 102 without having to rotate the tubing string 30 via the turntable 26.

Figure 2:
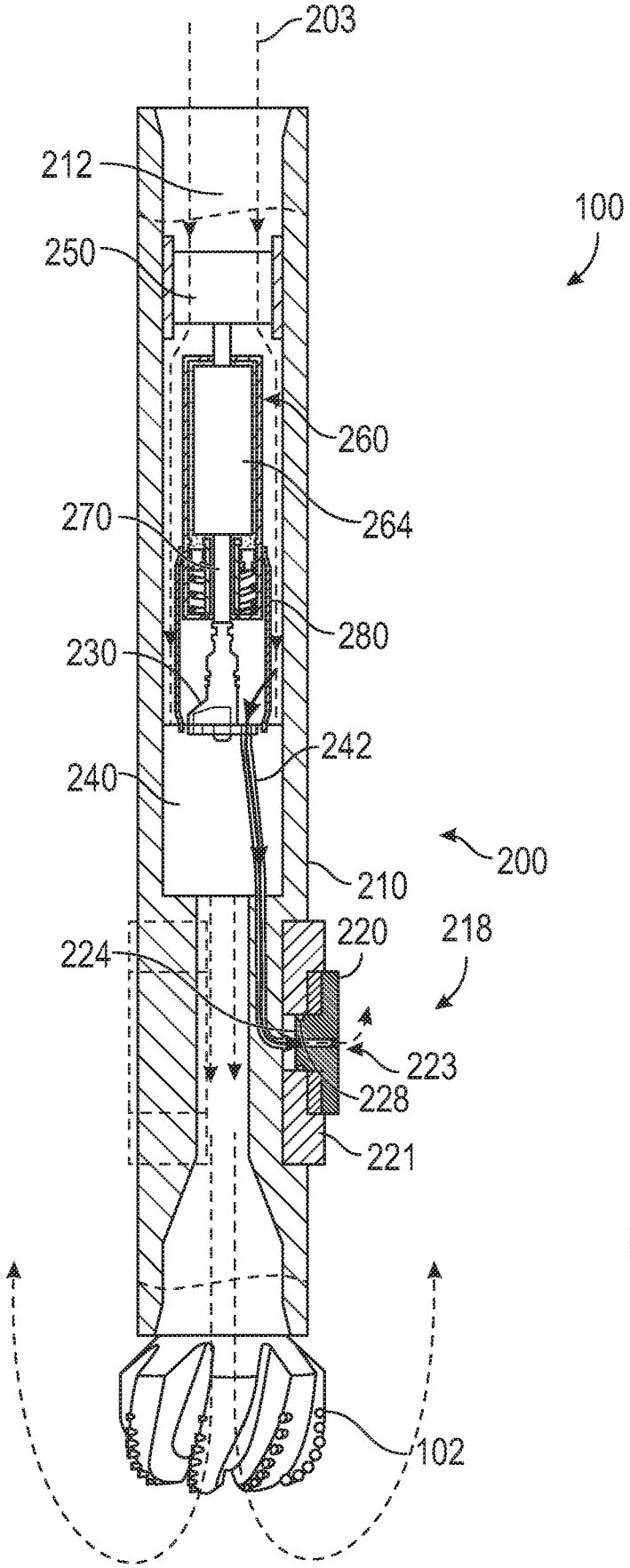
FIG. 2 illustrates a sectional view of the exemplary downhole tool of FIG. 1, including a steering head, according to some embodiments of the present disclosure.
Figure 3:
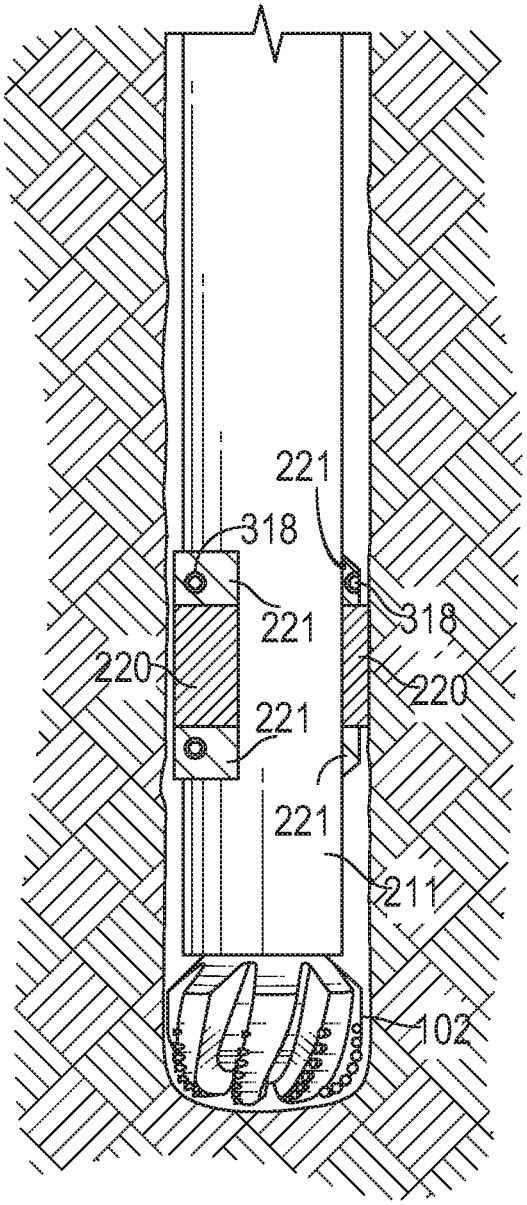
FIG. 3 illustrates a perspective side view of the exemplary downhole tool of FIG. 2.

FIG. 2 illustrates a sectional view of the exemplary downhole tool of FIG. 1, having a drill string steering system including a steering head, according to some embodiments of the present disclosure. FIG. 3 illustrates a perspective side view of the exemplary downhole tool of FIG. 2. According to various embodiments of the present inventions, the drill string system 200 includes a steering head 218 including one or more pad pushers 223. Although FIG. 2 depicts one pad pusher 223, the disclosed embodiments are not limited to this configuration. In some embodiments, as shall be later described, the steering head includes two pad pushers 223 (as illustrated in FIG. 3), and in other embodiments, three or more pad pushers 223. Each of the pad pushers 223 includes a steering pad 220 and a piston 224. As depicted, the steering pad 220 and the piston 224 may be coupled to each other using any suitable coupling mechanism. In some embodiments, the steering pad 220 and the piston 224 may be integrally formed as a single continuous body or material. In yet other embodiments, however, the piston 224 and the steering pad 220 may be separate components, with the piston 224 being actuatable to contact and move the steering pad 220 to push against the earth 102 to provide the desired drilling vector. As depicted in FIGS. 2 and 3, hydraulic fluid 203, e.g. mudflow flows into the drill string steering system 200 from the uphole end and passes through the central bore 212 to a rotary valve 230 and a flow manifold 240 to control mud flow to the piston 224 which then operates to extend the steering pad 220.

As depicted, the steering head 218 is configured with a channel or bore 226 in which the piston 224 reciprocates upon being hydraulically or otherwise actuated. In some embodiments, the piston channel or bore 226 may be a linear channel or bore. In yet other embodiments, the piston channel or bore 226 in which the piston 224 reciprocates may be a curved channel or bore.

As the mud flows through the central bore 212, the mud can flow through a turbine 250 and past an electric generator, steering controller and electric motor assembly 260 used to control the angular position of the rotary valve 230. In the depicted example, mudflow 203 can pass through a filter screen 280 prior to passing through the rotary valve 230 and the flow manifold 240. The filter screen 280 can include apertures or openings sized to allow the flow of mud while preventing debris from passing through the flow manifold 240 and to components downstream of the flow manifold 240 to prevent obstruction and damage to the downstream components. The filter screen 280 can be formed from a metallic or ceramic perforated cylinder or mesh or any other suitable filter material.

In the depicted example, the rotary valve 230 and the flow manifold 240 regulate or control the flow of the mud there through to control the extension of the steering pads 220. In some embodiments, the rotation of the rotary valve 230 abutted against the flow manifold 240 controls the flow of mud through the flow manifold 240. The rotary valve 230 is rotated by a motor 264 within an electric generator, steering controller and electric motor assembly 260.

In the depicted example, as mud flow is permitted by the rotary valve 230, the mud flow can continue in a piston flow channel 242 of the flow manifold 240. In some embodiments, a piston flow channel 242 can pass through the flow manifold 240 and the tool body 210 to provide mud flow to the piston channel or bore 226. In the depicted example, the tool body 210 includes one piston bore 226. However, as shall be illustrated and described in the various embodiments of the present disclosure, the tool body 210 can include one or more piston bores 226 formed in the tool body 210. In some embodiments, the piston bores 226 are disposed within pad retention housings 221 formed within the tool body 210. In the depicted example, mud flow from the piston flow channel 242 is received by the piston bore 226 and the piston seals 228 to actuate and extend the piston 226. As illustrated, the steering pad 220 is integrally formed with the piston 224. However, as previously discussed, the steering pad 220 and the piston 224 may be separately formed and otherwise coupled. As described herein, the combination of the steering pad 220 and the piston 224, whether being formed as separate parts that are coupled together, or being formed as a part of a single, continuous body, shall be referred to as a pad pusher 223. The pad pusher 223 may be actuated by the mud flow provided through the piston flow channel 242, for the piston 224 to extend the steering pad 220 radially outward against the wall of the wellbore 12.

Pressure against the piston 224 can be relieved by a relief flow channel 222 formed through the pad pusher 223. Mud flow can pass through the relief channel 222 to allow for maintaining or reducing pressure upon the piston 224 to facilitate the retraction of the piston 224 when the rotary valve 230 has closed mud flow to that piston.

In some embodiments, the mud flow can bypass the filter screen 280 and the flow past the manifold 240 to continue through the central bore 212 as a bypass flow 214. The bypass flow 214 can continue through the downhole end 204 of the drill string steering system 200 and can be directed to the bit nozzles 113 of the drill bit 102 to be circulated into an annulus of the wellbore 12.

In the depicted example, the motor 264 is an electrical motor that can be controlled to rotate the rotary valve 230 as desired to provide a desired drilling vector. In the depicted example, the motor 264 is contained within a motor housing 262 and rotates the rotary valve 230 via a motor shaft 270. In some embodiments, the motor 264 maintains the rotary valve 230 in a geostationary position as needed.

In the depicted example, components of the electric generator, steering controller and electric motor assembly 260 can be disposed, surrounded, bathed, lubricated, or otherwise exposed to a lubricant 265 within the motor housing 262 while many of the controller electronic components are protected in a protective pressure barrier cavity (not shown). In some embodiments the lubricant 265 is oil that is isolated from the mud within the wellbore. In the depicted example, the pressure of the lubricant 265 can be balanced with the downhole pressure of the mud. In some embodiments, a compensation piston 266 can pressurize the lubricant 265 to the same pressure as the surround mud without allowing fluid communication or mixing of the mud and the lubricant 265. In some embodiments, a biasing spring 268 can act upon the compensation piston 266 to further provide additional pressure to the lubricant 265 within the motor housing 262 relative to the pressure of the mud. The biasing spring 268 can impart around 25 psi of additional pressure, over the mud pressure, to the lubricant 265 within the motor housing 262. In some embodiments, electrical energy for the motor 264 is generated by mud flow passing through the turbine 250. In some embodiments, the turbine 250 can rotate about a turbine shaft 252 and power an electric generator.

In the embodiments, the steering pad 220 and the piston 224 are integrally formed. However, as previously discussed, the steering pad 220 and the piston 224 may be separately formed and otherwise coupled. The term "integrally formed" can refer to a configuration in which the steering pad 220 and the piston 224 are formed as a single, continuous body or material. Thus, the steering pad 220 and the piston 224 can move together along the same path. In some embodiments the path is a curved path which is defined by a curved piston liner defining the piston bore 226. In other embodiments, the piston channel or bore 226 may be a linear channel or bore. Thus, as depicted in FIG. 2, the piston 224 is actuated by the hydraulic fluid 203, e.g., pressurized mud flow, thereby causing the piston 224 and the steering pad 220 which move as an integral part, to move along the path defined by the piston liner. In some embodiments, the steering pad 220 can have a semi-circular cross-sectional profile.

In the example illustrated in FIG. 2, the pad pusher 223 is actuated by receiving mudflow 203 in the piston bore 226 from the piston flow channel 242. A piston seal 228 prevents the migration of fluid out of the piston bore 226. As the pad pusher 223 extends, the steering pad 220 can pivot relative to the tool collar 211.

Figure 4:
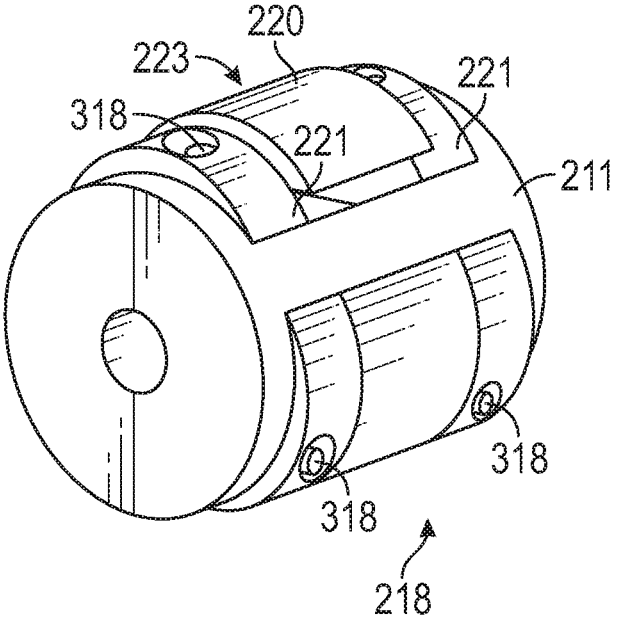
FIG. 4 illustrates an exemplary steering head mounted to a collar of the downhole tool, according to some embodiments.

FIG. 4 illustrates an exemplary steering head 218 mounted to a collar 211 of the downhole tool 100, according to some embodiments. In the depicted embodiments, the steering head 218 includes a plurality of pad pushers 223 mounted onto or about the collar 211. Although two pad pushers are depicted in FIG. 4, the steering head 218 is not limited to this configuration and may include only one pad pusher 223, or more than two pad pushers 223. In some embodiments, the steering head 218 includes one or more pad retention housings 221. Although two pad retention housings 221 are depicted in FIG. 4, the steering head 218 is not limited to this configuration and may include only one pad retention housing 221 or more than two pad retention housings 221. As illustrated in FIG. 4, each of the pad retention housings 221 may be mounted onto the collar 211 using fasteners 318. The fasteners 318 are positioned through each of the pad retention housings 221 to couple the pad retention housings 221 to each other around and/or through the collar 211.

As also illustrated in FIG. 4, each of the pad pushers 223 can be mounted to the collar 211 via a respective pad retention housing 211. That is, since each of the pad pushers 223 are directly, pivotally coupled to a respective housing 221, the pad pushers 223 are thus indirectly coupled to the collar 211 through the pad retention housings 221.

Figure 5:
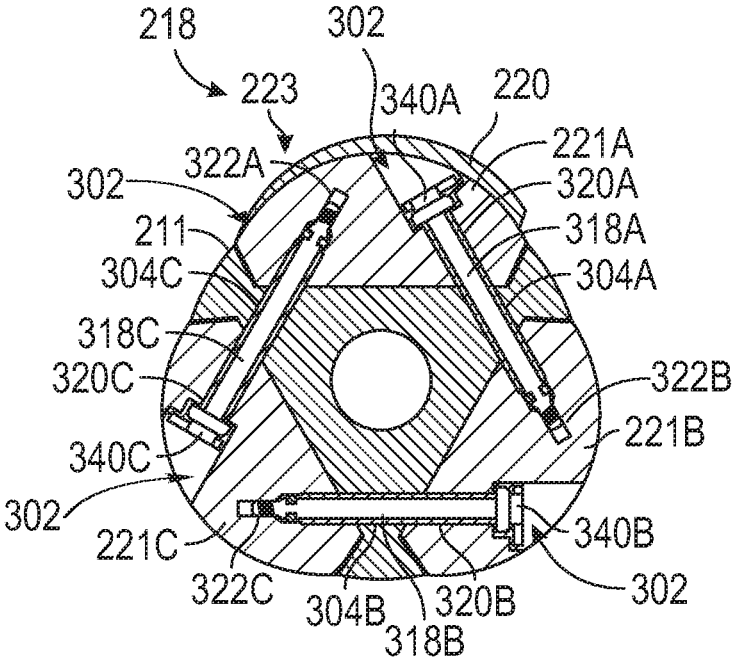
FIG. 5 is a cross-sectional view of the exemplary steering head of FIG. 4, illustrating coupling of a plurality of pad retention housings around the collar, according to some embodiments.

FIG. 5 is a cross-sectional view of the exemplary steering head 218 of FIG. 4, illustrating coupling of a plurality of pad retention housings 221 around the collar 211, according to some embodiments. In some embodiments, as illustrated in FIG. 5, the rotary steerable tool 100 includes first, second, and third pad retention housings 221A, 221B, and 221C coupled to each other as a unit about collar 211. In the example depicted in FIG. 5, each of the pad retention housings, e.g., housing 221A, includes a pad pusher 223 pivotally coupled thereto. In some embodiments, each of the retention housings 221A, 221B, and 221C includes a respective pad pusher 223 pivotally coupled thereto.

As depicted, each of the pad pushers 223, is positionable within a respective cavity of the tool collar 211. Each pad pusher 223 can be movable between a retracted position and an extended position (see e.g., steering pad 220, shown in FIGS. 4 and 5) relative to the tool collar 211. In the extended position, the steering pad 220 of each steering pad pusher 223 pivots radially outward with respect to the tool collar 211 to contact the formation so as to direct a steering direction of the downhole tool 100.

In the illustrated embodiments, the pad pushers 223 are fastened to each other as a unit around the collar 211. To this effect, the collar 211 includes a plurality of cavities 302 into which each of the pad pushers 223 are positioned to be coupled to the tool collar 211. Further, the collar 211 includes a plurality of through holes 304 (304A, 304B, and 304C) which extend transverse relative to a longitudinal axis of the tool collar 211 and extend intermediate the plurality of cavities 302. The through holes 304 can extend between adjacent cavities 302. For example, in some embodiments, the plurality of through holes 304 can penetrate from an outer circumferential surface of the tool collar 211 and extend in a direction generally in an orthogonal plane to the length of the tool collar 211.

Further, in accordance with the illustrated embodiments, each of the first, second, and third pad retention housings 221A, 221B, and 221C has a respective through hole 320A, 320B, and 320C for receiving a first end of a respective fastener 318 therein. Additionally, each of the first second and third pad retention housings 221A, 221B, and 221C include an engagement hole 320A, 320B, and 320C for receiving a second end of the fastener 318 therein. Thus, each of the fasteners 318 can extend between adjacent pad retention housings 221A, 221B, and 221C to interconnect the pad pushers 223 around the tool collar.

For example, as illustrated in FIG. 5, a first fastener 318A extends through the through hole 320A of the first pad retention housing 211A, through the tool collar through hole 304A, and into the engagement hole 322B of the adjacent second pad retention housing 221B. Similarly, a second fastener 318B extends through the through hole 320B of the second pad retention housing 211B, through the tool collar through hole 304B, and into the engagement hole 322C of the adjacent third pad retention housing 221C. This pattern can be repeated for two, three, four, or more pad retention housings. In the illustrated embodiments, the pad retention housings 221A, 221B, and 221C may be arranged in a triangular, cross-sectional configuration around the tool collar 211. Thus, a third fastener 318C can extend through the through hole 320C of the third pad retention housing 211C, through the tool collar through hole 304C, and into the engagement hole 322A of the adjacent first pad retention housing 221A. However, the various embodiments described herein are not limited to the aforementioned configuration. For example, in some embodiments, the pad retention housings may be coupled to each other in a square or rectangular configuration. In these embodiments, four pad retention housings may be provided along with four fasteners.

Advantageously, in contrast to configurations in which each steering pad or pad retention housing is separately coupled directly to the collar 211, the aforementioned configuration in which the pad retention housings 221A, 221B, and 221C are interconnected to each other by being coupled together about the tool collar 211, allows for longer, wider, larger (e.g., diametrically larger), bulkier, or otherwise stronger fasteners to be used. This indirect fastening of the pad retention housings to the tool collar can therefore enable greater fastener strength and tool collar strength and integrity when compared with conventional steering heads where the steering pads or the steering pad housings are each separately bolted directly to the tool collar. In the conventional steering heads, the size of the bolt is generally confined to an overall cross-sectional combined depth or height of the tool collar and the associated pad pusher. Further, the tool collar geometry is also constrained and limited by the multiplicity of fasteners and fastener engagement holes in the tool collar. For example, while three pad pushers require twelve holes and twelve apertures for conventional designs, some embodiments disclosed herein having three pad pushers would require only six holes and six apertures. Moreover, advantageously, longer, larger fasteners have better vibration absorption capabilities, thereby providing an additional level of security against loosening of the fasteners which couple the housings together about the collar, and against the bolted parts becoming loose or coming apart. Moreover, in some embodiments, the indirect coupling of the pad retention housings 221A, 221B, and 221C to the tool collar 211 reduces the number of fasteners and fastener engagement holes, which can allow the design of the tool collar 211 to be stronger, more robust, and more durable.

Further, the configuration in which the pad retention housings 221A, 221B, and 221C are interconnected by being coupled together about the tool collar 211, as opposed to each being separately coupled to just the collar 211 allows for the through holes 304A, 304B, and 304C of the collar to be free of threading. This is advantageous the lack of threading reduces the stress concentrations in the collar 211 that result from threading the collar 211 which could increase the chance of fatigue cracking failures of the collar.

In some embodiments, each of the pad retention housings 221A, 221B, and 221C can include a two part-housing having opposing sections of each housing being disposed on either side of a space or receptacle in which the respective pad pusher 223 can move. Further, each section of the housing can be fastened to the tool collar 211 via two apertures and a fastener. Thus, a total of six fasteners (in the triangular coupling configuration), and a total of eight fasteners (in the square/rectangular coupling configuration) maybe provided for each steering head 218 of the present disclosure.

In accordance with some embodiments, as illustrated, the fasteners 318 (318A, 318B, and 318C) may each be a bolt having a head 340 (340A, 340B, and 340C) at a first end portion. The head 340 can be configured to enable application of a torque thereto in order to tightly secure the bolts 318 within the housings 221 (221A, 221B, and 221C) during assembly. As illustrated in FIG. 5, each bolt head 340 is disposed, for example, in a first housing, e.g. pad retention housing 221A, and a second end portion of the bolt is positioned in the engagement hole 322B of the adjacent housing 221B so as to securely mount each of the respective pad pushers 223 to the collar 221.

Figure 6A:
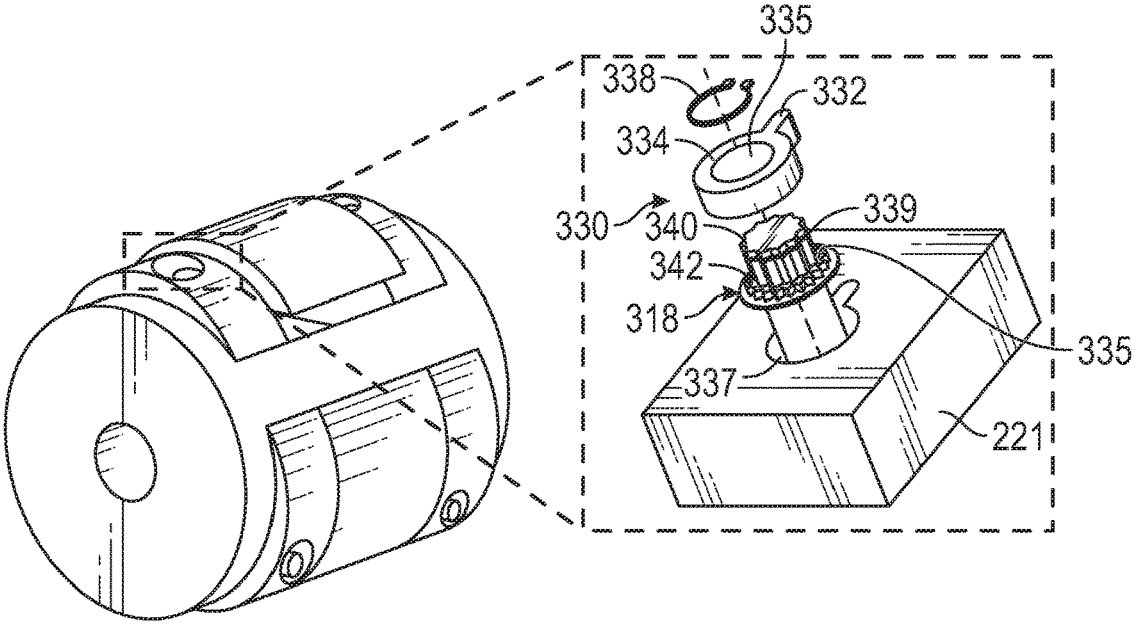
FIG. 6A illustrates a partially enlarged exploded view of steering head of FIG. 4, including an anti-rotation member for preventing rotation of a fastener used to secure the steering head to the collar, in accordance with some embodiments.

FIG. 6A illustrates a partially enlarged, exploded view of steering head of FIG. 4, including an anti-rotation member (also shown in FIG. 6B) for preventing rotation of a fastener used to secure the steering head to the collar, in accordance with some embodiments. FIG. 7 illustrates a partially enlarged view of the fastener with anti-rotation member assembled in the pad retention housing, in accordance with some embodiments.

As described above, the fasteners may be, but are not limited to, bolts 318. In the depicted embodiments, each pad retention housing 221 includes a recess 337 surrounding an upper end portion of the housing through-hole 320. The recess 337 may be shaped in the form of a keyhole, but is not limited to this shape.

Figure 6B:
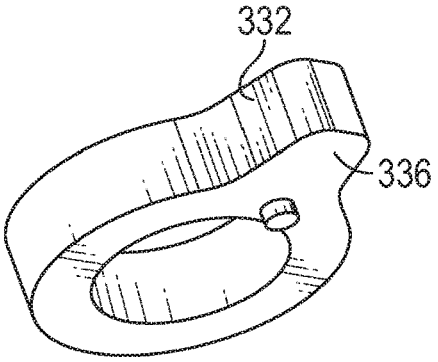
FIG. 6B illustrates the anti-rotation member of FIG. 6A, in accordance with some embodiments.
Figure 7:
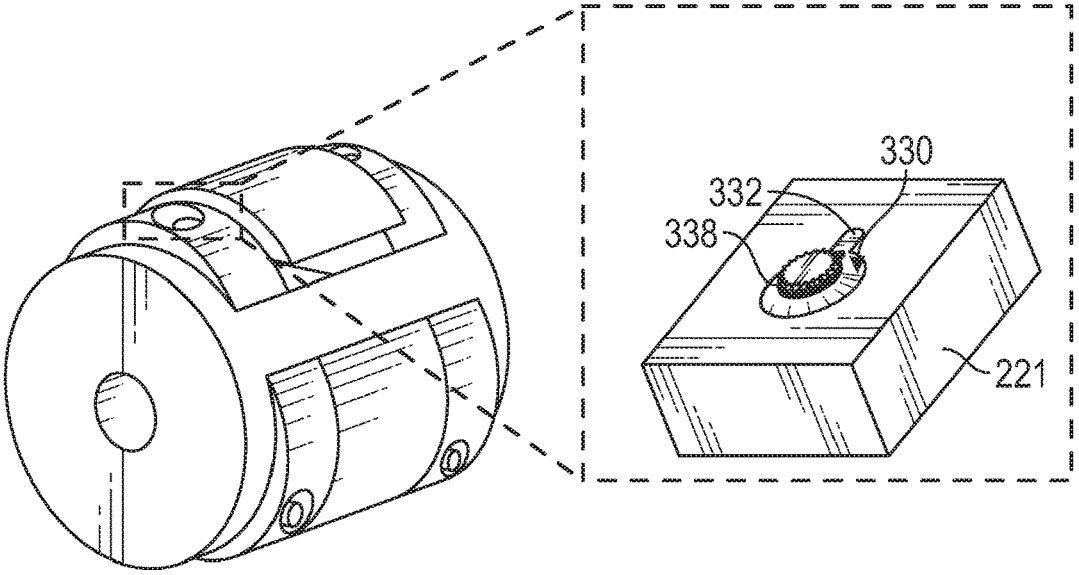
FIG. 7 illustrates a partially enlarged view of the fastener with anti-rotation member assembled in the pad retention housing, in accordance with some embodiments.

As illustrated in FIGS. 6A and 6B, each pad retention housing 221 of the steering head 218 includes an anti-rotation member 330 for preventing the bolt 318 from loosening and disengaging from the pad retention housing 221. The anti-rotation member 330 is configured to be placed over the head 340 of the bolt 318. As depicted in FIG. 6A, the anti-rotation member 330 is a hollow body 334 having a central aperture 335 defined therethrough along an axial direction of the hollow body 334. The anti-rotation member 330 is further formed with an arm 332 extending radially outward from the anti-rotation member 330 for engaging in the housing 221 to prevent rotational motion of the bolt 318 with respect to the housing 221.

In some embodiments, as shown in FIG. 6B, the arm 332 has a protrusion 336, or indentions or at least one slot extending vertically from a lower horizontal surface of the arm 332 for engaging with a notch 335 disposed at least partially through a flange 342 of the bolt 318. As depicted, the central aperture 335 slides onto the bolt head 340, with the anti-rotation member 330 positioned such that when disposed on the bolt head, the protrusion 336 is engaged in the notch 335 to prevent the anti-rotation member 335 from rotating relative to the bolt 318.

As illustrated in FIG. 7, the anti-rotation member is to be positioned within the keyhole-shaped recess with the hollow body 334 and the arm 332 being fully recessed therein to prevent relative rotation between the anti-rotation member and the housing. In accordance with some embodiments, the bolt 318 includes a groove 339 disposed around an outer circumference of the bolt head 340. As part of the system, a retention member 338 can be placed into the groove 339 in order to secure the anti-rotation member 330 to the bolt head 340. This can provide an extra degree of security or robustness with respect to mounting of the bolt 318 in the housing. Thus, as depicted in FIG. 7, the retention member 338 can secure the anti-rotation member to the bolt. The above-described configuration, which uses an anti-rotation member, can advantageously provide anti-back-off protection at the head end of the bolt 318 to prevent the bolt from rotating out of the pad retention housing.

Figure 8:
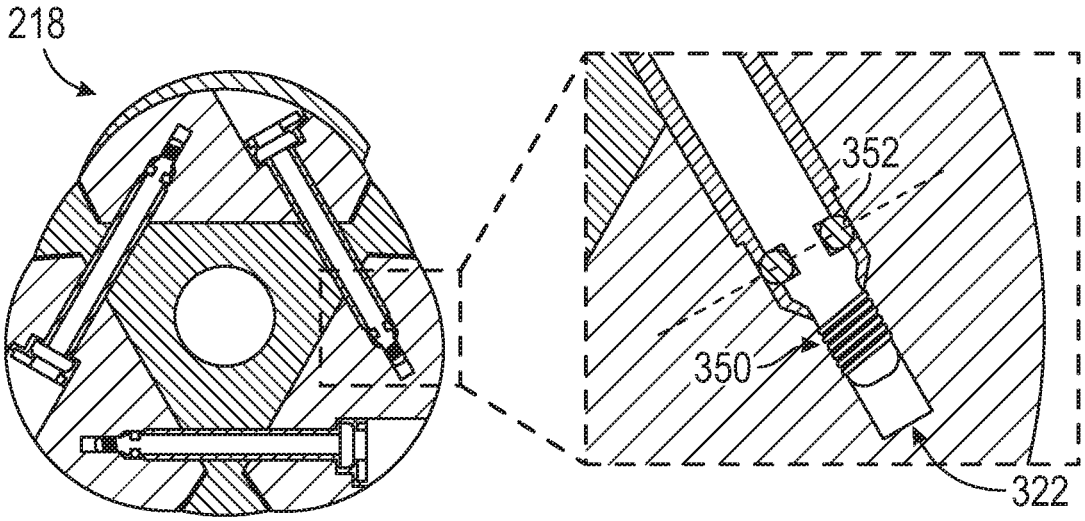
FIG. 8 illustrates a partially enlarged cross-sectional view of a hydraulic seal for securing an end portion of the fastener within the pad retention housing, in accordance with some embodiments.

FIG. 8 illustrates a partially enlarged cross-sectional view of a hydraulic seal for securing an end portion of the fastener within the pad retention housing, in accordance with some embodiments. In the depicted embodiments, each bolt 318 includes an engagement portion 350 having threading at the second of the bolt 318 end opposite to the bolt head 340. A seal 352 may be advantageously positioned on a radial exterior of the engagement portion 350. The seal 352 can be positioned at the engagement portion 350 of the bolt 318.

The seal 352 can protect the bolt threads from contaminants and corrosion, and to prevent back-off. However, the seal 352 may further function to prevent the bolt 318 from becoming loose and to keep the bolt in place against mechanical vibrations experienced during drilling operations. For example, an outer periphery of the seal can be configured to contact an inner surface of the engagement hole 322 to seal a small pocket of air at assembly location (above ground) ambient pressure beneath the seal 352, within the engagement hole 322. When the tool 100 is positioned downhole, hydrostatic pressure exceeds the above-ground pressure of the quantity of air sealed within the engagement hole 322 to act against the seal 352 and drive the seal 352 and the bolt engagement portion 350 toward the bottom portion of the engagement hole 322. This can function to maintain engagement of the bolt 318 with the housing engagement hole 322. Advantageously, the higher hydrostatic pressures at the below-ground level acting upon the seal 352 and the engagement portion 350 work to hold the bolt 318 in place against mechanical vibration.

Figure 9:
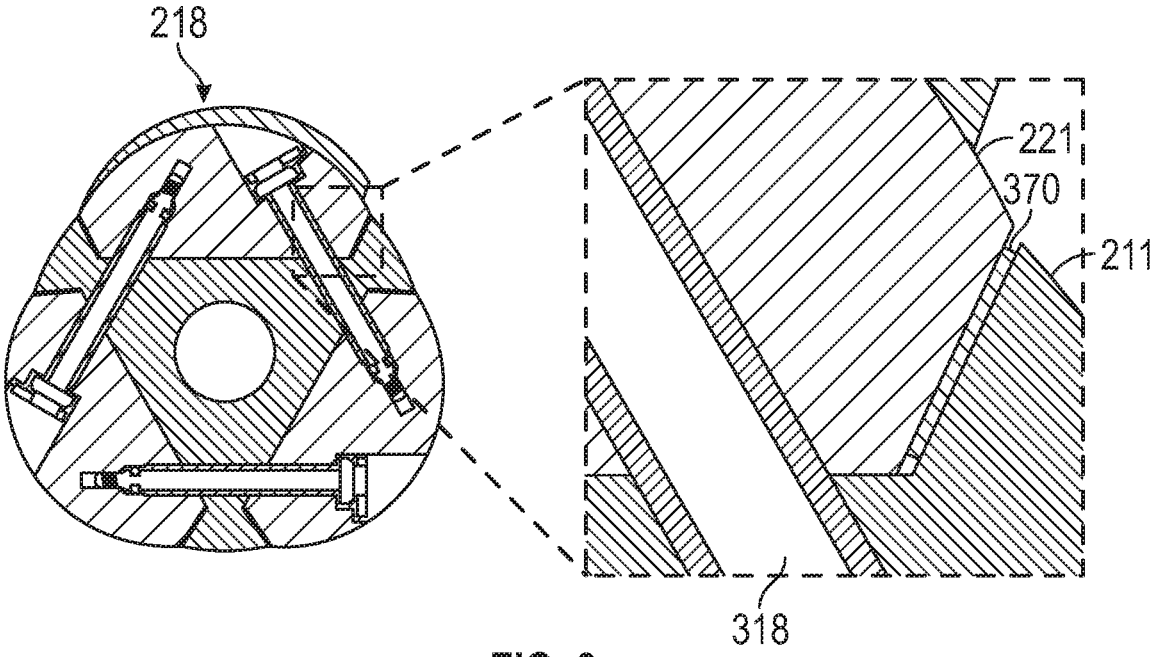
FIG. 9 illustrates an enlarged partial view of a shim used to secure a pad retention housing of the steering head to the collar, in accordance with some embodiments.

FIG. 9 illustrates an enlarged partial view of a shim used to secure a pad retention housing of the steering head to the collar, in accordance with some embodiments. In some embodiments, as illustrated in FIG. 9, the downhole tool 100 includes a shim 370 interposed between the collar 212 and at least one of the pad-retention housings 221. The shim 221 can be positioned between the collar 212 and at least one of the pad-retention housings 221. In such embodiments, the shim 221 thereby reduces any potential gaps between the collar 212 and the pad-retention housings 221. As a result, the shim 221 can reduce freedom of movement of the housings 221, which may create downhole problems due to mechanical vibrations in the tool 100. In particular, the shim 370 can be positioned to restrain movement of the pad retention housings 221 relative to the collar 211, thereby restricting lateral movement of the pad pushers 223 with respect to the collar 211.

The aforementioned configurations of pad pushers and pad retention housings, taken individually or combined, can each provide the advantage of decreasing the negative effects that downhole vibrations will have on the reliability of the steering pads 220 downhole. The robust design of the pad pushers described herein improves downhole reliability, resulting in fewer drilling hours lost for tool repairs and reduced replacement and maintenance costs. Further, threaded bolt holes do not need to be machined into the collar, thereby simplifying collar design and reducing potential stress concentrations which would have resulted from threading.

Various examples of aspects of the disclosure are described as numbered clauses (1, 2, 3, etc.) for convenience. These are provided as examples and do not limit the subject technology. Identification of the figures and reference numbers are provided below merely as examples for illustrative purposes, and the clauses are not limited by those identifications.

Clause 1: A rotary steerable tool for steering a drill string, the tool comprising: a tool collar having a plurality of cavities and a plurality of through holes extending therethrough to interconnect the plurality of cavities; a plurality of pad pushers, each being positionable within the plurality of cavities to be coupled to the tool collar, each pad pusher being coupled to a pad retention housing, the pad pusher being movable between retracted and extended positions relative to the tool collar for steering the drill string, the pad retention housing having an engagement hole extending partially therethrough and a through hole spaced apart from the engagement hole, the engagement hole and the through hole being alignable with corresponding through holes in the tool collar; and a plurality of fasteners, each extending between adjacent pad retention housings to interconnect the plurality of pad pushers around the tool collar, each fastener extending from a respective pad retention housing through hole, through a tool collar through hole, and into an engagement hole of an adjacent pad retention housing to interconnect adjacent pad retention housings.

Clause 2: The tool of Clause 1, wherein each of the fasteners are positioned on a single plane.

Clause 3: The tool of Clause 1, wherein each of the housings are angularly positioned with respect to each other about a circumference of the tool collar.

Clause 4: The tool of Clause 3, wherein the fasteners are angularly mounted in the respective housings together to form a triangular configuration.

Clause 5: The tool of Clause 3, wherein the fasteners are angularly mounted in the respective housings together to form a square configuration.

Clause 6: The tool of Clause 3, further comprising a shim interposed between the collar and at least one of the pad-retention housings to restrain movement of the housings relative to the collar and restrict lateral movement of the pad pushers with respect to the collar.

Clause 7: The tool of Clause 1, wherein each fastener comprises a bolt having a head at a first end portion thereof for applying a torque thereto.

Clause 8: The tool of Clause 7, wherein the bolt head is disposed in a first housing and a second end portion of the bolt is disposed in the engagement hole of an adjacent housing.

Clause 9: The tool of Clause 8, wherein the second end portion of the bolt includes threads, and the engagement hole of the adjacent housing includes threading complimentary to the threading at the second end portion of the bolt for threaded connection of the bolt to the adjacent housing.

Clause 10: The tool of Clause 9, wherein the through holes in the collar are free of threading.

Clause 11: The tool of Clause 7, wherein the bolt first end portion comprises a flange including a notch disposed at least partially therethrough.

Clause 12: The tool of Clause 11, further comprising an anti-rotation member, wherein the anti-rotation member includes a central aperture and an arm extending radially outward from the anti-rotation member, the arm including a protrusion extending vertically from a lower horizontal surface of the arm, the central aperture being configured to slide onto the bolt head, wherein when disposed on the bolt head, the protrusion is engaged in the notch to prevent the anti-rotation member from rotating relative to the bolt.

Clause 13: The tool of Clause 12, wherein each pad retention housing comprises has a keyhole-shaped recess surrounding an upper end portion of the housing through-hole, the anti-rotation member being positionable within the keyhole-shaped recess with the arm preventing relative rotation between the anti-rotation member and the housing.

Clause 14: The tool of Clause 13, further comprising a retention member, wherein the head of the bolt includes a groove disposed around an outer circumference of thereof, and the retention member is disposed in the groove to secure the anti-rotation member to the bolt.

Clause 15: The tool of Clause 1, wherein each fastener comprises a bolt having a head at a first end portion thereof for applying a torque thereto and an engagement portion at a second end portion thereof.

Clause 16: The tool of Clause 15, wherein the engagement end portion has a seal coupled to a radial exterior thereof, an outer periphery of the seal being configured to contact an inner surface of the engagement hole when disposed therein to seal a quantity of air within the engagement hole at a bottom portion of the engagement hole, the quantity of air being at an above-ground air pressure, wherein when the tool is positioned downhole, hydrostatic pressure exceeds the above-ground air pressure of the quantity of air to act against the seal and drive the seal and bolt engagement end portion toward the bottom portion of the engagement hole for maintaining engagement of the bolt with the housing engagement hole.

Clause 17: A method of assembling a rotary steerable tool for steering a drill string, the method comprising: providing a tool collar having a plurality of cavities and a plurality of through holes therethrough to interconnect the plurality of cavities; and mounting a pad pusher within each of the cavities of the tool collar, each pad pusher being coupled to a pad retention housing, wherein the mounting includes: aligning each of (1) an engagement hole extending partially through each pad retention housing, and (2) a through hole spaced apart from the engagement hole in each pad retention housing with corresponding through holes in the tool collar; and positioning a fastener in each of the housings, each fastener positioned to extend between adjacent pad retention housings to interconnect the pad pushers around the tool collar, each fastener extending from a respective pad retention housing through hole, through a tool collar through hole, and into an engagement hole of an adjacent pad retention housing to interconnect adjacent pad retention housings.

Clause 18: The method of Clause 17, further comprising interposing a shim between the collar and at least one of the housings to secure the housings in the collar and prevent lateral movement of the pad pusher with respect to the collar.

Clause 19: The method of Clause 17, wherein the fastener comprises a bolt having a flange with a notch disposed at least partially therethrough.

Clause 20: The method of Clause 19, further comprising: disposing an anti-rotation member on a head of the bolt, wherein the anti-rotation member includes a central aperture and an arm extending radially outwardly from the anti-rotation member, the arm including a protrusion extending vertically from a horizontal plane of the arm, the central aperture being configured to slide onto the bolt head and the anti-rotation member configured to be placed in a recess in each pad retention housing; engaging the protrusion in the notch to prevent the anti-rotation member from rotating relative to the bolt; and positioning the anti-rotation member in the recess to restrict rotation of the bolt with respect to the housing.

Clause 21: The method of Clause 20, further comprising fitting a retention member in a groove defined around an outer circumference of the bolt head to secure the anti-rotation member to the bolt.

Clause 22: The method of Clause 17, wherein each fastener comprises a bolt having a head at a first end portion thereof for applying a torque thereto and an engagement portion at a second end portion thereof.

Clause 23: The method of Clause 22, further comprising coupling a seal to a radial exterior of the engagement end portion, an outer periphery of the seal being configured to contact an inner surface of the engagement hole when disposed therein to seal a quantity of air within the engagement hole at a bottom portion of the engagement hole, the quantity of air being at an above-ground air pressure, wherein when the tool is positioned downhole, hydrostatic pressure exceeds the above-ground pressure of the quantity of air to act against the seal and drive the seal and bolt engagement end portion toward the bottom portion of the engagement hole for maintaining engagement of the bolt with the housing engagement hole.

What is claimed is:

1. A rotary steerable tool for steering a drill string, the tool comprising:

a tool collar having a plurality of cavities and a plurality of through holes extending therethrough to interconnect the plurality of cavities;

a plurality of pad pushers, each being positionable within the plurality of cavities to be coupled to the tool collar, each pad pusher being coupled to a pad retention housing, the pad pusher being movable between retracted and extended positions relative to the tool collar for steering the drill string, the pad retention housing having an engagement hole extending partially therethrough and a through hole spaced apart from the engagement hole, the engagement hole and the through hole being alignable with corresponding through holes in the tool collar; and a plurality of fasteners, each extending between adjacent pad retention housings to interconnect the plurality of pad pushers around the tool collar, each fastener extending from a respective pad retention housing through hole, through a tool collar through hole, and into an engagement hole of an adjacent pad retention housing to interconnect adjacent pad retention housings.

2. The tool of claim 1, wherein each of the housings are angularly positioned with respect to each other about a circumference of the tool collar.

3. The tool of claim 2, further comprising a shim interposed between the collar and at least one of the pad retention housings to restrain movement of the housings relative to the collar and restrict lateral movement of the pad pushers with respect to the collar.

4. The tool of claim 1, wherein each fastener comprises a bolt having a head at a first end portion thereof for applying a torque thereto.

5. The tool of claim 4, wherein the bolt head is disposed in a first housing and a second end portion of the bolt is disposed in the engagement hole of an adjacent housing.

6. The tool of claim 5, wherein the second end portion of the bolt comprises threads, and the engagement hole of the adjacent housing includes threading complimentary to the threading at the second end portion of the bolt for threaded connection of the bolt to the adjacent housing.

7. The tool of claim 6, wherein the through holes in the collar are free of threading.

8. The tool of claim 4, wherein the bolt first end portion comprises a flange including a notch disposed at least partially therethrough.

9. The tool of claim 8, further comprising an anti-rotation member, wherein the anti-rotation member includes a central aperture and an arm extending radially outward from the anti-rotation member, the arm including a protrusion extending vertically from a lower horizontal surface of the arm, the central aperture being configured to slide onto the bolt head, wherein when disposed on the bolt head, the protrusion is engaged in the notch to prevent the anti-rotation member from rotating relative to the bolt.

10. The tool of claim 9, wherein each pad retention housing comprises a keyhole-shaped recess surrounding an upper end portion of the housing through hole, the anti-rotation member being positionable within the keyhole-shaped recess with the arm preventing relative rotation between the anti-rotation member and the housing.

11. The tool of claim 10, further comprising a retention member, wherein the head of the bolt includes a groove disposed around an outer circumference of thereof, and the retention member is disposed in the groove to secure the anti-rotation member to the bolt.

12. The tool of claim 1, wherein each fastener comprises a bolt having a head at a first end portion thereof for applying a torque thereto and an engagement portion at a second end portion thereof.

13. The tool of claim 12, wherein the engagement end portion has a seal coupled to a radial exterior thereof, an outer periphery of the seal being configured to contact an inner surface of the engagement hole when disposed therein to seal a quantity of air within the engagement hole at a bottom portion of the engagement hole, the quantity of air being at an above-ground air pressure, wherein when the tool is positioned downhole, hydrostatic pressure exceeds the above-ground air pressure of the quantity of air to act against the seal and drive the seal and bolt engagement end portion toward the bottom portion of the engagement hole for maintaining engagement of the bolt with the housing engagement hole.

14. A method of assembling a rotary steerable tool for steering a drill string, the method comprising:

providing a tool collar having a plurality of cavities and a plurality of through holes extending therethrough to interconnect the plurality of cavities; and mounting a pad pusher within each of the cavities of the tool collar, each pad pusher being coupled to a pad retention housing, wherein the mounting includes:

aligning each of (1) an engagement hole extending partially through each pad retention housing, and (2) a through hole spaced apart from the engagement hole in each pad retention housing with corresponding through holes in the tool collar; and positioning a fastener in each of the housings, each fastener positioned to extend between adjacent pad retention housings to interconnect the pad pushers around the tool collar, each fastener extending from a respective pad retention housing through hole, through a tool collar through hole, and into an engagement hole of an adjacent pad retention housing to interconnect adjacent pad retention housings.

15. The method of claim 14, further comprising interposing a shim between the collar and at least one of the housings to secure the housings in the collar and prevent lateral movement of the pad pusher with respect to the collar.

16. The method of claim 14, wherein the fastener comprises a bolt having a flange with a notch disposed at least partially therethrough.

17. The method of claim 16, further comprising:

disposing an anti-rotation member on a head of the bolt, wherein the anti-rotation member includes a central aperture and an arm extending radially outwardly from the anti-rotation member, the arm including a protrusion extending vertically from a horizontal plane of the arm, the central aperture being configured to slide onto the bolt head and the anti-rotation member configured to be placed in a recess in each pad retention housing;

engaging the protrusion in the notch to prevent the anti-rotation member from rotating relative to the bolt; and positioning the anti-rotation member in the recess to restrict rotation of the bolt with respect to the housing.

18. The method of claim 17, further comprising fitting a retention member in a groove defined around an outer circumference of the bolt head to secure the anti-rotation member to the bolt.

19. The method of claim 14, wherein each fastener comprises a bolt having a head at a first end portion thereof for applying a torque thereto and an engagement portion at a second end portion thereof.

20. The method of claim 19, further comprising coupling a seal to a radial exterior of the engagement end portion, an outer periphery of the seal being configured to contact an inner surface of the engagement hole when disposed therein to seal a quantity of air within the engagement hole at a bottom portion of the engagement hole, the quantity of air being at an above-ground air pressure, wherein when the tool is positioned downhole, hydrostatic pressure exceeds the above-ground pressure of the quantity of air to act against the seal and drive the seal and bolt engagement end portion toward the bottom portion of the engagement hole for maintaining engagement of the bolt with the housing engagement hole.

* * * * *